United States Patent [19]

Rugenstein et al.

[11] Patent Number: 4,460,088

[45] Date of Patent: Jul. 17, 1984

[54] SOFT PACK CONSISTING OF A PLASTIC FILM, ESPECIALLY FOR PAPER HANDKERCHIEFS

[75] Inventors: Rolf K. A. Rugenstein; Dieter Brahmst; Wolfgang Lippert, all of Bremen, Fed. Rep. of Germany

[73] Assignee: Christian Senning Verpackungsautomaten, Bremen, Fed. Rep. of Germany

[21] Appl. No.: 506,852

[22] Filed: Jun. 22, 1983

Related U.S. Application Data

[63] Continuation of Ser. No. 204,670, Nov. 5, 1980.

[30] Foreign Application Priority Data

Dec. 8, 1979 [DE] Fed. Rep. of Germany ..... 2949496

[51] Int. Cl.[3] ..... B65D 27/34; B65D 27/36

[52] U.S. Cl. ..... 206/494; 206/611; 206/625; 206/632; 206/633

[58] Field of Search ..... 206/625, 626, 813, 628, 206/632, 633, 264; 229/87 C; 206/608–612, 494

[56] References Cited

U.S. PATENT DOCUMENTS

| | | | |
|---|---|---|---|
| 797,337 | 8/1905 | Wilson | 206/628 |
| 1,291,984 | 1/1919 | Maloney | 206/628 |
| 2,020,799 | 11/1935 | Randall | 206/633 |
| 2,026,477 | 12/1935 | Lescher | 229/87 C |
| 2,109,100 | 2/1938 | Brophy | 229/87 C |
| 2,194,168 | 3/1940 | Klein | 206/813 |
| 2,242,694 | 5/1941 | Booth | 206/264 |
| 2,305,428 | 12/1942 | Johnson | 206/264 |
| 2,400,406 | 5/1946 | Godoy | 206/632 |
| 2,476,740 | 7/1949 | Krall | 206/628 |
| 2,529,853 | 11/1950 | Taggart . | |
| 3,522,907 | 8/1970 | Vtterback, Jr. | 206/628 |
| 3,620,441 | 11/1971 | Robbins | 206/628 |
| 3,652,008 | 3/1972 | Grotefend | 206/628 |
| 4,193,501 | 3/1980 | Allen | 206/632 |
| 4,220,244 | 9/1980 | Elmore | 206/628 |
| 4,260,061 | 4/1981 | Jacobs | 206/626 |

FOREIGN PATENT DOCUMENTS 3307 of 1915 United Kingdom .

*Primary Examiner*—Stephen P. Garbe

*Attorney, Agent, or Firm*—Sughrue, Mion, Zinn, Macpeak and Seas

[57] ABSTRACT

A soft plastic pack for paper facial tissues includes, at one end of a front wall 15, a tear-open flap 26 defined by converging perforation lines 29, 30 extending inwardly from corners 27, 28 of the pack. The lines are joined by a through cut 32, which is overlaid by an adhesive strip 40 to facilitate initial opening and reclosing.

4 Claims, 7 Drawing Figures

SOFT PACK CONSISTING OF A PLASTIC FILM, ESPECIALLY FOR PAPER HANDKERCHIEFS

This application is a continuation, of application Ser. No. 204,670, filed Nov. 5, 1980.

DESCRIPTION

The invention relates to a soft pack consisting of a plastic film for paper pulp products, especially for holding paper handkerchiefs, serviettes, sanitary towels, and the like, with a substantially cuboid construction forming a front wall, a rear wall, side walls and end walls (pack walls), parts of the pack which are limited by perforation lines being openable by tearing.

Paper pulp products, namely folded paper handkerchiefs, but also paper serviettes and the like, are packed predominantly in blanks consisting of plastic films, preferably polyethylene. The abovementioned packaging material has a number of advantages, but, on the other hand, also the disadvantage that special measures have to be taken to open the pack by tearing open the plastic film.

The approximately cuboid soft pack for holding, for example, ten paper handkerchiefs is often provided, for the abovementioned reasons, with a perforation line which runs all around the upper region of which extends over a part-region. It is possible by means of this perforation line to tear an opening cap wholly or partly off the remaining part of the pack. The contents of the pack are thereby exposed for removal.

However, a reclosable soft pack for paper handkerchiefs is also already known. In the region of a narrow long side face of the pack, closing flaps of the blank of plastic film are folded over one another and are joined to one another only lightly, that is to say releasably, by means of welding. Applied on the outside is an adhesive tape which adheres releasably to the film and which has a non-adhesive gripping end. By partly pulling off the adhesive tape the projecting closure of this soft pack is opened, the outer closing flap being detached from that lying below it by pulling up the adhesive tape. By means of transverse cuts in the closing flaps these can be moved to the side, so that access to the contents of the pack becomes possible.

The abovementioned pack for paper handkerchiefs is, above all, expensive in terms of material, since rather strong and, moreover, specially treated films must be used as packaging material.

The object of the invention is to propose a soft pack for paper pulp products, which consists of a plastic film and which can be reliably opened and reclosed, without special measures in terms of material having to be taken for the purpose.

To achieve this object, the pack according to the invention is characterised in that at least one of the pack walls, especially the large-area front wall (or rear wall), is provided with a tear-open flap which narrows to a grippable flap end and which is limited by perforation lines or by other markings guaranteeing the tearability of the material.

Accordingly, in the pack according to the invention there is formed in the region of one of the pack walls, especially in the upper region of the (rectangular) front wall, a tear-open flap which is limited by perforation lines favouring the tearing-open operation because of their arrangement. According to this teaching, the said perforation lines are arranged so that they diverge from the flap end, but at an angle to one another which is less than 180°. Differently shaped paths of the perforation lines from the approximately central flap end are correspondingly possible, for example a trapezoidal, triangular or curved shape of the perforation lines.

In the preferred embodiment of the invention, the tear-open flap is arranged in the upper region of the vertical rectangular front or rear wall in such a way that the perforation lines departing from the flap end towards the sides run approximately up to vertical lateral edges and, indeed, in the upper corners of the pack. Furthermore, the perforation lines preferably extend into the region of the end side.

Alternatively, a tear-open flap can be arranged in the region of a narrow vertical side face, in such a way that the flap end is adjacent the lower end face of the pack. Here, perforation lines are formed substantially along the vertical longitudinal edges and, indeed, up to approximately the upper end face of the pack, so that, in this alternative, substantially the entire side face can be exposed by means of the tear-open flap.

A feature common to all the embodiments of this pack is that the tear-open flap is opened towards the (upper) end face of the pack.

It is further provided that an adhesive tape (known per se) consisting of a film coated with an adhesive is allocated to the tear-open flaps. This adhesive tape is fixed for a (predominant) part to the tear-open flap by adhesion, overlaps the flap end and furthermore, is connected releasably to the adjoining part of the pack or of the blank. A gripping end free of adhesive enables the pack to be opened by detaching the adhesive tape from the pack and by pulling open the tear-open flap by further pulling of the adhesive tape.

Further features of the pack according to the invention are the subject of the sub-claims.

Exemplary embodiments of the invention are explained in more detail below with reference to the drawings wherein.

Figure 1:
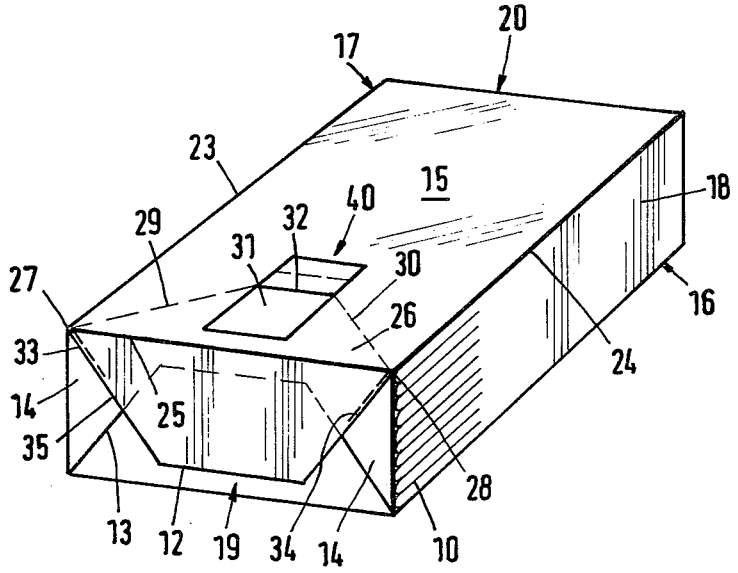
FIG. 1 is a first embodiment, in perspective, of a (cuboid) pack consisting of a plastic film for holding paper handkerchiefs.

The drawings illustrate exemplary embodiments of soft packs which serve here, for example, to hold paper handkerchiefs 10. Packs for holding other paper pulp articles, for example sanitary towels, serviettes, and the like, can be designed correspondingly.

The substantially cuboid packs consist, here, of a one-piece rectangular blank 11 (FIG. 3) of a weldable or gluable plastic film, for example polyethylene. The blank 11 is first laid around the contents of the pack to form a tube. End flaps 12 and 13 or 14 which project at the ends are then folded over towards the contents of the pack. The individual areas of the blank 11 which are marked by corresponding lines in FIG. 3 thereby form a front wall 15, a rear wall 16, relatively narrower side walls 17 and 18 and end walls 19 and 20.

The last-mentioned end walls 19, 20 are formed by the correspondingly folded end flaps 12, 13, 14 of which the (outer) end flap 12 allocated to the front wall 15 as well as the corresponding end flap 13 adjoining the rear wall 16 acquire a trapezoidal shape due to the folding operation. The end flaps 12, 13, 14 are joined to one another by thermal welding, but optionally also by adhesion.

Side strips 21 and 22 of the blank 11 constitute in the region of the side wall 17 an overlapping which is not shown in detail here. The side strips 21, 22 are likewise joined to one another by thermal welding.

The said pack walls 15–20 are delimited in respect of one another by edges, by the longitudinal edges 23 and 24 in the region of the front wall 15 and by a transverse edge 25 in respect of the end wall 19.

The packs are opened by tearing, but can be reclosed after part of the contents has been removed.

In the preferred exemplary embodiment illustrated here, the rectangular front wall 15 is provided, in the upper region adjacent the end wall 19, with a tear-open flap 26 which extends preferably over the entire width of the front wall 15. This tear-open flap accordingly has in the widest region a transverse dimension corresponding to the smaller (transverse) dimension of the front wall.

The tear-open flap 26 is marked and limited by tearing lines which permit the tearing-open operation because of a material weakening of the plastic film. In the present illustrative embodiments the tear-open flap 26 is limited by perforation lines 29, 30 which point, in the broadest sense, in the tear-open direction, that is to say, in the direction of the end wall 19, but, in any case, run at an angle to one another which is less than 180°.

In the illustrative embodiment according to FIG. 1, the tear-open flap 26 thereby acquires a substantially trapezoidal shape by means of two perforation lines 29 and 30 which run respectively to the corners 27 and 28 of the front wall 15. A flap end 31 lying approximately centrally to the front wall 15 is marked here by a continuous parting cut 32 which joins to one another the adjacent ends of the perforation lines 29, 30. This parting cut facilitates the critical start of the tearing-open operation by gripping and pulling up the flap end 31.

In order to provide by means of the tear-open flap 26 an opening which facilitates removal of the contents of the pack, the perforation lines 29, 30 are continued by adjoining perforations 33 and 34 in the region of the end wall 19, namely at the margin or within a lateral folding edge 35 of the outer end flap 12. The adjoining perforations 33, 34 can be designed also as a continuous parting cut.

Figure 3:
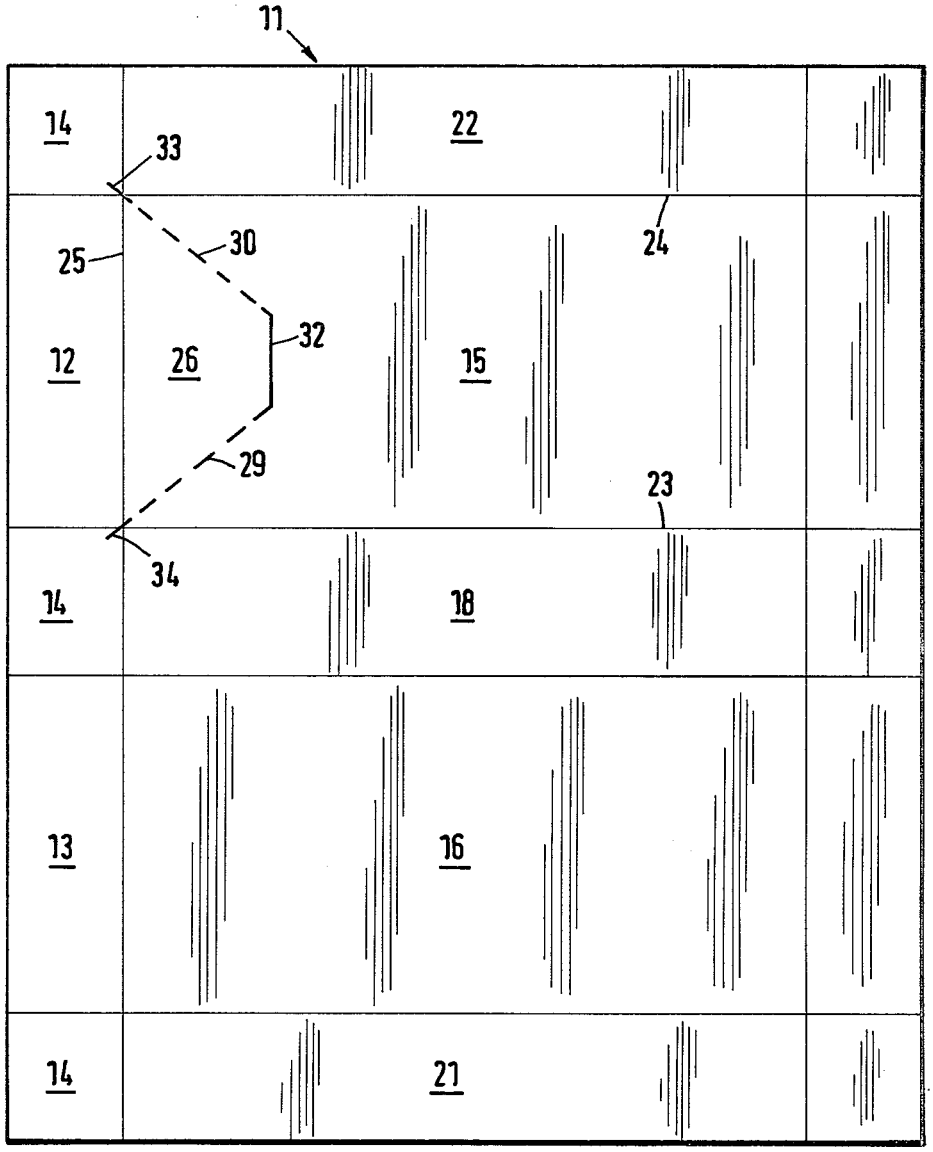
FIG. 3 shows a spread-out blank of plastic film for manufacturing a pack with the features of the exemplary embodiment according to FIG. 1.

The pattern of perforation lines 29, 30, including parting cuts 32, which is obtained in this illustrative embodiment is recognisable in FIG. 3. The simple geometrical shape can be made very simple by means of appropriate cutting knives.

Figure 2:
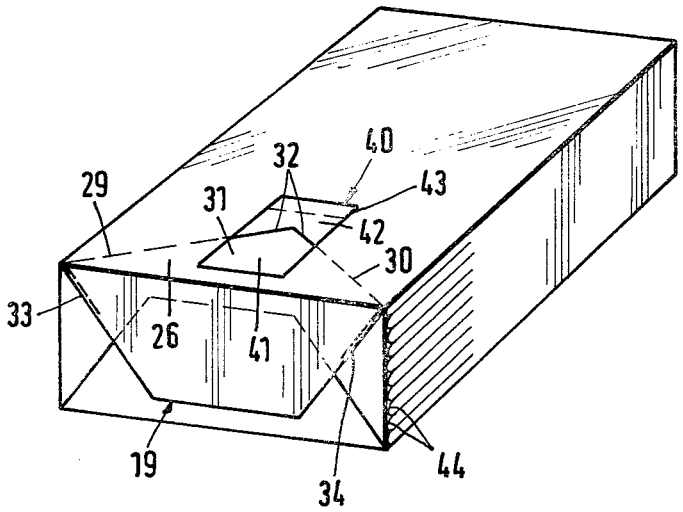
FIG. 2 is an embodiment, likewise in perspective, of the pack according to FIG. 1, with an alternative tear-open flap.

In the illustrative embodiment according to FIG. 2, a modification is made, to the extent that the flap end 31 is limited by a V-shaped parting cut 32 whose legs constitute the continuation of the perforation lines 29, 30, so that the tear-open flap 26 as a whole assumes here the form of a triangle.

Figure 4:
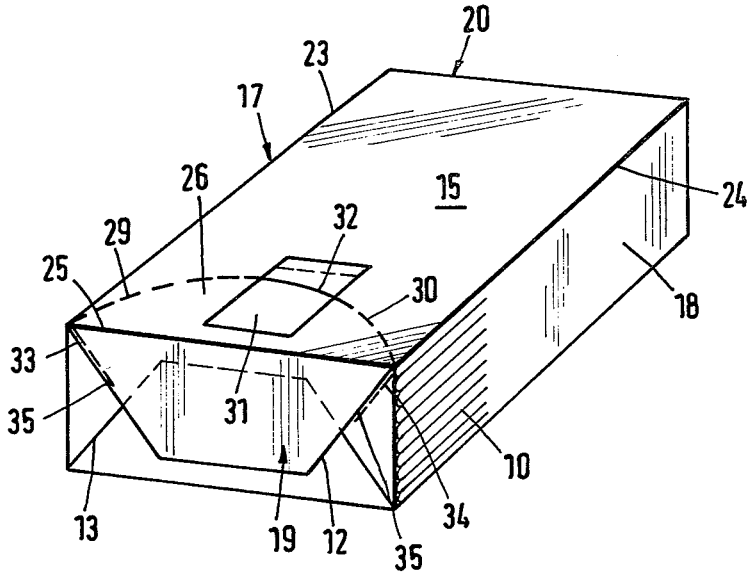
FIG. 4 is an illustrative embodiment, in perspective, of the pack with a curvedly limited tear-open flap.

FIG. 4 shows an illustrative embodiment in which the perforation lines 29, 30 run, as a continuation of the parting cut 32, in a curved, especially arcuate manner, and, indeed, into the corners 27, 28 of the front wall 15. The tear-open flap 26 thus formed thereby acquires the geometrical shape of a circle segment.

Figure 5:
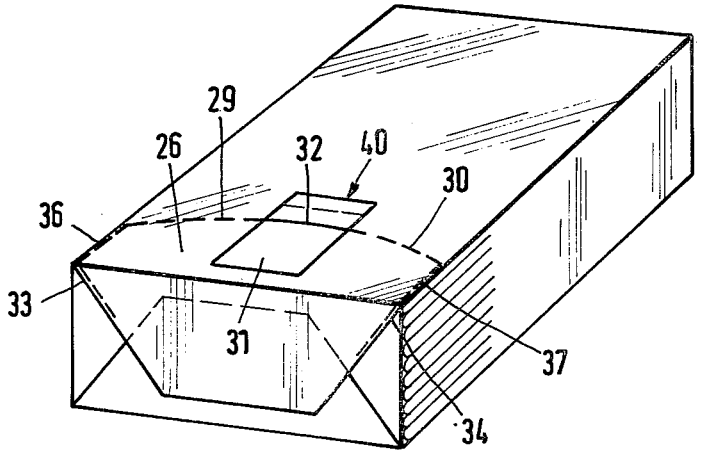
FIG. 5 shows a further alternative with regard to the shape of the tear-open flap.

In the illustrative embodiment according to FIG. 5, there are likewise provided curved perforation lines 29, 30 which adjoin a parting cut 32 marking the flap end 31. However, these perforation lines run at a distance from the end wall 19 to the margin of the front wall 15, namely to the longitudinal edges 23, 24. Within these an adjoining perforation 36, 37 extends up to the corners 27 and 28 of the front wall 15.

Figure 6:
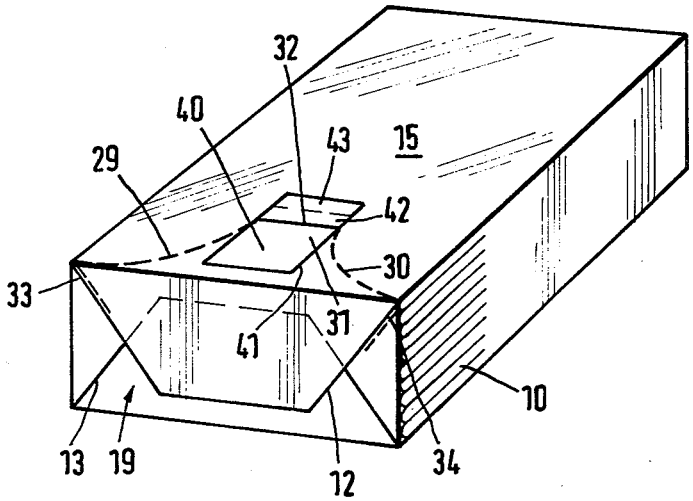
FIG. 6 shows an illustrative embodiment with a concavely shaped tear-open flap.

In the illustrative embodiment according to FIG. 6, the flap end 31 of the tear-open flap 26 is especially accentuated, since the flap end 31 is made tongue-like due to a concave shaping of the perforation lines 29 and 30. A transverse parting cut 32 adjoins here, also, the ends of the perforation lines 29, 30. The perforation lines 29, 30 lead here into the corners 27 and 28 of the pack.

Figure 7:
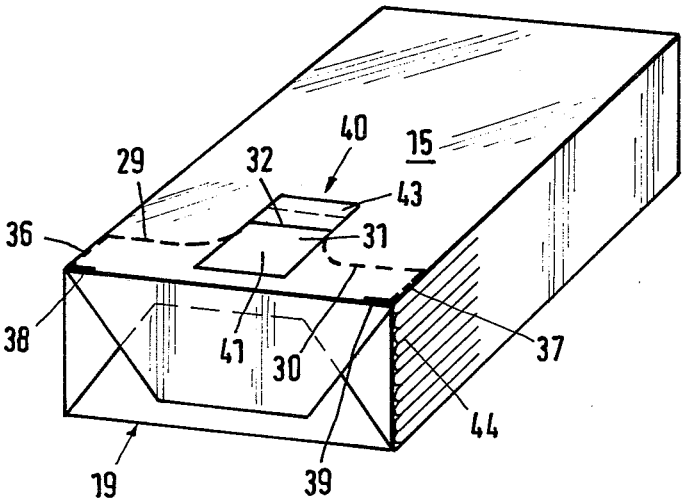
FIG. 7 shows a modification to the illustrative embodiment according to FIG. 6.

The embodiment according to FIG. 7 corresponds, in principle, to that described above, but, here, the perforation lines 29, 30 which adjoin the flap end 31 run curvedly in the first region and then substantially transversely. They run up to the longitudinal edges 23, 24 and, in the region of these, with adjoining perforations 36, 37 up into the corners 27, 28. There then follow further adjoining perforations 38, 39 which run, however, in contrast to the preceding illustrative embodiments, along the transverse edge 25 formed between the end wall 19 and front wall 15.

In all exemplary embodiments, a closing element in the form of an adhesive tape 40 is allocated respectively to the tear-open flaps 26. This closing element is connected by a (longer) sticking section 41 to the tear-open flap 26 by adhesion. The adjoining pull-off part 42 is made with a considerably smaller sticking area and is connected releasably by adhesion to the adjoining part of the front wall 15. A nonadhesive gripping flap 43 formed at the end of the adhesive tape 40 enables the adhesive tape 40 to be gripped and pulled off. In so doing, with the pack closed, the pull-off part 42 is first detached from the front wall 15. Upon a further pulling-off movement of the adhesive tape 40, the tear-open flap 26 is detached from the front wall 15 along the perforation lines 29, 30, and the like, since the adhesive tape 40 remains connected to the tear-open flap 26 because of corresponding adhesion. By means of this tearing-open operation there is exposed an opening which corresponds to the above-described perforation lines, adjoining perforations, and the like, and which enables the contents of the pack to be removed. After a partial removal the pack can be reclosed, namely by means of the adhesive tape 40. A repeated opening and closing operation can be performed.

In the present case, the adhesive tape 40 is arranged so that the parting cut 32 is covered in the region of the flap end 31. The width of the adhesive tape 40 therefore corresponds, here, approximately to the length of the parting cut 32. Alternatively, however, the parting cut can be taken partly up into the region of the perforation lines 29, 30 for a better marking of the flap end 31, especially in the embodiments according to FIGS. 1 and 2 as well as 6 and 7. It is appropriate, in so doing, to make the adhesive tape 40 correspondingly wider, so that the parting cut 32 is also covered in this alternative.

The folded paper handkerchiefs 10 are appropriately so arranged that an end fold faces the pack opening formed by the tear-open flap 26, so that it becomes easier to grip the paper handkerchiefs 10 for the purpose of removal.

We claim:

1. A soft dispenser package of plastic film for accommodating disposable cellulose paper handkerchiefs, said package having a generally parallelepiped configuration including a front wall, a rear wall, opposed side walls and opposed end walls, at least one perforation line defined in at least one of said walls to implement the tear opening of the package, and an adhesive strip connected at its respective ends to adjacent wall portions of said package on opposite sides of said perforation line, characterized by:

(a) two generally converging perforation lines (29, 30) jointly defining a boundary of a tear open flap (26) on the front wall (15) of said package, (b) a transversely directed, continuous separating cut (32) in said front wall delimiting a finger grippable end (31) of said flap, (c) opposite ends of said separating cut directly joining with converging ends of said perforation lines at an angle such that upon pulling an end of said adhesive strip upwardly to initially open the package, tearing force is directed along said perforation lines toward opposite corners (27, 28) of the front wall adjacent an end wall (19) of the package, (d) the adhesive strip (40) engaging said flap end and an immediately adjacent portion of said front wall and sealingly overlying said separating cut when said package is closed, the width of the adhesive strip corresponding to the length of the speparating cut, (e) diverging ends of the perforation lines extending outwardly to said opposite corners (27, 28) of the front wall adjacent said end wall (19) of the package, (f) connecting perforation lines (33, 34) further defining said flap in said end wall and continuing from said perforation lines at said corners, and (g) the adhesive strip having a non-adhesive grip tab (43) on its end engaging said front wall, whereby upon opening said flap exposes a full width portion of said front wall together with a full width portion of said end wall, to thereby enable the easy removal of individual handkerchiefs from the package, wherein (h) the end wall (19) is formed, in sequence, by folding in opposite first and second flaps (14) adjoining the side wall, a third flap (13) adjoining the rear wall, and a fourth trapezoidal flap (12) adjoining the front wall, (i) the connecting perforation lines in the end wall are provided in the first and second flaps and run along lateral folded edges (35) of the fourth flap, and (j) a plurality of paper handkerchiefs arranged in a stack in the package with end folds (44)thereof directed towards the opening formed by the tear flap to facilitate seizing the handkerchiefs when removing them.

2. A soft package according to claim 1, wherein the tear open flap is tapered towards the finger grippable end of the flap.

3. A package according to claim 1, wherein the separating cut (32) lies in a straight line, and with the converging perforation lines defines a trapezoidal shape for the tear open flap.

4. A package according to claim 1, wherein the separating cut (32) lies in a straight line, and the converging perforation lines run in concave arcs to define a tongue shape for the tear open flap.

* * * * *